US009539702B2

(12) United States Patent
Kunihiro et al.

(10) Patent No.: US 9,539,702 B2
(45) Date of Patent: Jan. 10, 2017

(54) ABRASIVE GRINDING WHEEL

(71) Applicant: TOYODA VAN MOPPES LTD., Okazaki-shi (JP)

(72) Inventors: Yasuji Kunihiro, Okazaki (JP); Masayuki Shimizu, Okazaki (JP); Takuma Kono, Okazaki (JP); Tsutomu Kato, Okazaki (JP)

(73) Assignee: TOYODA VAN MOPPES LTD., Okazaki-shi (JP)

( * ) Notice: Subject to any disclaimer, the term of this patent is extended or adjusted under 35 U.S.C. 154(b) by 0 days.

(21) Appl. No.: 14/603,773

(22) Filed: Jan. 23, 2015

(65) Prior Publication Data

US 2015/0258661 A1 Sep. 17, 2015

(30) Foreign Application Priority Data

Mar. 12, 2014 (JP) ..... 2014-048432

(51) Int. Cl.
*B24D 5/02* (2006.01)
*B24D 18/00* (2006.01)

(52) U.S. Cl.
CPC ..... *B24D 5/02* (2013.01); *B24D 18/0072* (2013.01)

(58) Field of Classification Search
CPC ..... B23F 21/03; B24D 5/02; B24D 18/0072; B24D 18/00
USPC ..... 451/541, 544, 546, 543, 450
See application file for complete search history.

(56) References Cited

U.S. PATENT DOCUMENTS

| | | | | |
|---|---|---|---|---|
| 2,279,486 | A * | 4/1942 | Patt | B24D 5/08 451/543 |
| 6,358,133 | B1 * | 3/2002 | Cesena | B24D 3/06 451/450 |
| 6,827,641 | B2 * | 12/2004 | Yoshida | B24D 5/066 451/541 |
| 2002/0068518 | A1 | 6/2002 | Cesena et al. | |
| 2003/0176157 | A1 | 9/2003 | Yoshida et al. | |
| 2004/0082290 | A1 * | 4/2004 | Yoshida | B24D 5/14 451/546 |

FOREIGN PATENT DOCUMENTS

| | | |
|---|---|---|
| CN | 202825583 U | 3/2013 |
| CN | 103213075 A | 7/2013 |
| JP | 2003-260668 | 9/2003 |

OTHER PUBLICATIONS

Chinese Office Action dated Sep. 13, 2016, and issued in corresponding Chinese patent application No. 201510089938.X, (6 pages).

* cited by examiner

*Primary Examiner* — Robert Rose
(74) *Attorney, Agent, or Firm* — Oblon, McClelland, Maier & Neustadt, L.L.P.

(57) ABSTRACT

The abrasive grinding wheel includes an annular abrasive grain layer formed by a diamond abrasive grain or CBN abrasive grain and fixed to an outer peripheral surface of a cylindrical grinding wheel core by an adhesive agent. The abrasive grinding wheel further includes a waterproof agent applied on both side end surfaces and an inner peripheral surface of the cylindrical grinding wheel core in order to prevent any water ingress into the inside of the core.

10 Claims, 1 Drawing Sheet

ABRASIVE GRINDING WHEEL

This application claims priority under 35 U.S.C. 119 with respect to Japanese Application No. 2014-048432 filed in Japan on Mar. 12, 2014, the entire content of which is herein incorporated by reference.

BACKGROUND OF THE INVENTION

This invention relates to an abrasive grinding wheel which can prevent invasion of water into a core of the grinding stone.

As an example of a centerless grinding machine, as descried in a Patent Literature 1, an abrasive grinding wheel is used which is equipped with an abrasive grain on an outer peripheral portion of the core of the grinding wheel. A normal grinding wheel formed by sintering powders such as alumina which is light in weight and relatively smaller in heat expansion performance characteristics is used for the core of the abrasive grinding wheel.

DOCUMENT LIST OF STATE OF ART

Patent Document

Patent Literature 1 JP2003-260668

DISCLOSURE OF INVENTION

Problems to be Solved

According to a centerless grinding machine, normally a coolant is supplied into the abrasive grinding portions upon grinding a workpiece or a grinding object. Such coolant is entered into the grinding wheel core formed by a regular grinding wheel. Due to such invasion or ingress of the coolant, the grinding wheel loses the balance upon rotation and such imbalance causes an adverse effect on the accuracy of grinding of the workpiece.

For this reason, conventionally, the coolant which had been invaded into the core of the grinding wheel have been discharged by draining or the like by compulsively idly rotating the grinding wheel when the centerless grinding machine is stopped to avoid the above adverse effect.

The invention was made in consideration of the above conventional drawbacks and it is an object of the invention to provide an improved abrasive grinding wheel which avoids the ingress of water (coolant) into the grinding wheel core by applying a waterproof agent on the outer surface of the core.

Means for Solving the Problems

According to a first aspect of the invention to solve the above problems, the abrasive grinding wheel includes an annular abrasive grain layer formed by a diamond abrasive grain or CBN abrasive grain and fixed to an outer peripheral surface of a cylindrical grinding wheel core by an adhesive agent, wherein a waterproof agent is applied on both side end surfaces and an inner peripheral surface of the cylindrical grinding wheel core.

According to the above first aspect of the invention, the coolant which is supplied to the workpiece upon grinding would not enter into the inside of the cylindrical grinding wheel core. Accordingly, the abrasive grinding wheel can be kept in good balance during the rotation operation and the grinding accuracy of the workpiece can be stably kept.

According to the invention associated with a second aspect, in the first aspect, the cylindrical grinding wheel core is made by the cylindrical grinding wheel core is formed by WA magnet or GC magnet.

According to the second aspect of the invention, the weight of the grinding wheel core can be reduced and at the same time the heat expansion performance characteristics can be minimized.

According to the invention associated with a third aspect, in the first or the second aspect, a resin-made guide member is fixed to at least one end of the abrasive grain layer in an axial line direction of the cylindrical grinding wheel core.

According to the third aspect of the invention, when the abrasive grinding wheel is adapted to the centerless grinding machine, the behavior of the workpiece is stabilized by the resin-made guide member when the workpiece is fed into a space between the abrasive grinding wheel and an adjusting grinding wheel and/or when the workpiece is fed out from the space between the abrasive grinding wheel and the adjusting grinding wheel. Accordingly, the abnormal abrasion of the grinding wheel or a generation of a feeding mark to the workpiece can be prevented.

BRIEF EXPLANATION OF THE ATTACHED DRAWINGS

These and other features of the invention will become more apparent from the following detailed description of the embodiments with reference to the attached drawings, in which.

THE EMBODIMENTS FOR IMPLEMENTING THE INVENTION

Figure 1:
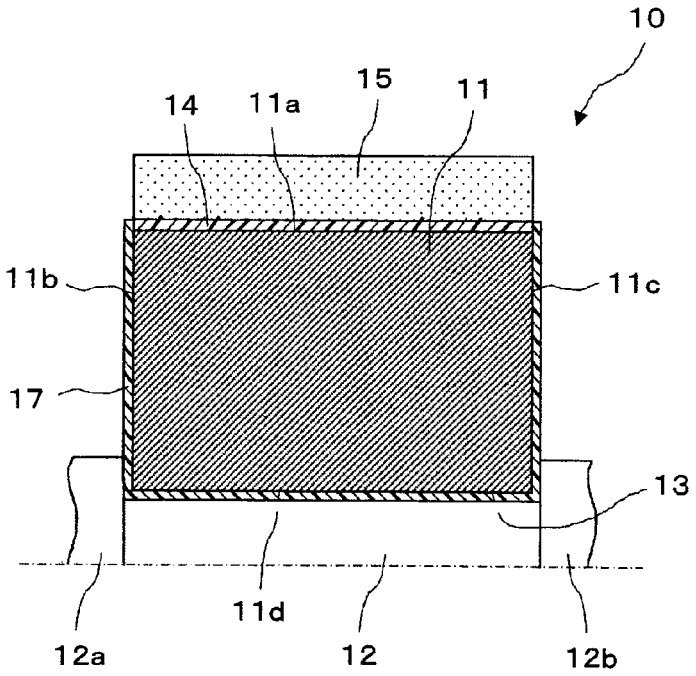
FIG. 1 is a cross sectional view of the abrasive grinding wheel according to a first embodiment of the invention.

The first embodiment of the invention will be explained with reference to the attached drawings. FIG. 1 indicates an abrasive grinding wheel 10 of the first embodiment of the invention. The abrasive grinding wheel 10 includes a cylindrical grinding wheel core 11 which is provided with an attaching bore 13 at the center thereof for fitting engagement with a rotation shaft 12 of a cylindrical grinding machine.

The grinding wheel core 11 is made preferably of a material which is light in weight and small in heat expansion performance characteristics such as for example, a WA (white alundum) grinding wheel which is formed by sintering powder of alumina ($Al_2O_3$) or a GC (green carbon) grinding wheel which is formed by sintering powder of silicon carbide (SiC) is suitable.

An adhesive agent 14 is applied on the outer peripheral surface 11*a* of the grinding wheel core 11 and an annular abrasive grain layer 15 bound with ultra-abrasive grain such as, a diamond abrasive grain or a CBN (Cubic Boron Nitride) abrasive grain by a binder agent is fixed to the outer peripheral surface 11*a* of the grinding wheel core 11 by the adhesive agent 14. The adhesive agent 14 is formed by an epoxy resin which has a waterproof function.

The abrasive grain layer 15 is manufactured to have the same length in an axial direction with the grinding wheel core 11 and is fixed thereto so that the side surface of the abrasive grain layer 15 and both side surfaces 11*b* and 11*c* of the cylindrical grinding wheel core 11 are arranged to agree to each other in the same plane. The grinding wheel core 11 is supported between large diameter flange portions 12*a* and 12*b* provided on a rotation shaft 12 to restrict an axial displacement of the grinding wheel core 11 relative to the rotation shaft 12 and attached on the rotation shaft 12 integrally.

A water proof agent 17 is applied on the entire surface area of both side surfaces 11*b* and 11*c* and the inner peripheral surface 11*d* of the grinding wheel core 11 without any gap. The water proof agent 17 is formed by an epoxy resin and has a water proof function. It is noted that the water proof agent 17 to be applied on the both side surfaces 11*b* and 11*c* of the grinding wheel core 11 is applied to the portion where the water proof agent overlaps with the adhesive agent 14 so that any water (coolant) cannot enter into the border portion with the adhesive agent 14. Accordingly, the entire outer surface area (11*a* through 11*d*) of the grinding wheel core 11 is covered by the adhesive agent 14 and the water proof agent 17 so that the entering of water (coolant) into the inside of the grinding wheel core 11 can be prevented.

According to the first embodiment of the invention, since the entire outer surfaces (11*a* through 11*d*) of the grinding wheel core 11 are covered by the adhesive agent 14 and the water proof agent 17, the coolant which is supplied to a workpiece upon grinding operation cannot enter into the inside of the grinding wheel core 11. Thus, the abrasive grinding wheel 10 can be always rotated with a good balance and an accuracy of grinding of the workpiece can be stably maintained.

Figure 2:
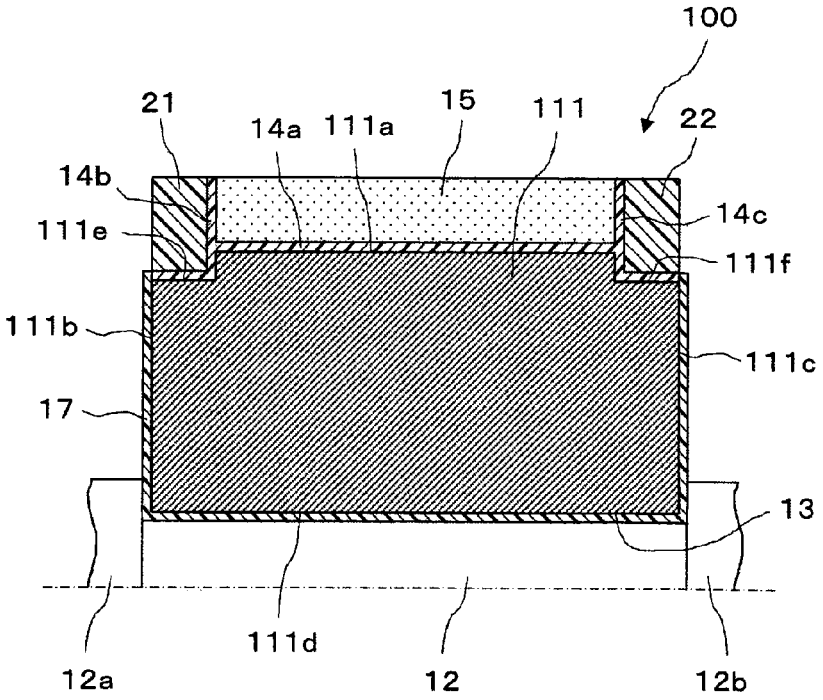
FIG. 2 is a cross sectional view of the abrasive grinding wheel according to a second embodiment of the invention.

FIG. 2 shows a second embodiment of the invention and indicates the abrasive grinding wheel to be applied to a centerless abrasive grinding wheel 100. It is noted that the components corresponding to those used in the first embodiment are referred to as the same reference numerals and the detail explanation thereof will be omitted.

According to the second embodiment, stepped attaching portions 111*e* and 111*f* are formed at the both end portions of the outer periphery of the grinding wheel core 111 for attaching a resin made guide which will be explained later in detail. An abrasive grain layer 15 is fixed to the outer peripheral surface 111*a* of the grinding wheel core 111 by an adhesive agent 14*a*. The length in an axial direction of the grinding wheel core 111 is larger than the length of the abrasive grain layer 15 except the length of the outer peripheral portion.

The resin made guides 21 and 22 are fixed to the end surfaces of the both end portions of the abrasive grain layer 15 and the stepped attaching portions 111*e* and 111*f* and a peripheral surface of the grinding wheel core 111 by the adhesive agents 14*b* and 14*c*.

It is noted that according to the second embodiment, also a water proof agent 17 is applied on the both side surfaces 111*b* and 111*c* and the inner peripheral surface 111*d* of the grinding wheel core 111 so that any water (coolant) cannot enter into the inside of the grinding wheel core 111, as is the same effect of the first embodiment.

According to the second embodiment, when the workpiece is fed to the position between the abrasive grinding wheel of the centerless grinding machine and the adjusting grinding wheel, any flip-flopping by the workpiece, which might be generated upon the feeding, can be prevented by providing the resin guide 21 at one side (inlet side). Thus, the behavior of the workpiece can be stabilized, thereby avoiding a generation of abnormal abrasion or the defect at the end surface portion of the abrasive grinding wheel 10. At the other side (outlet side), another resin guide 22 is provided not to generate any feeding mark, such as a spiral mark or a traverse mark on the workpiece when the workpiece is fed out from the position between the abrasive grinding wheel and the adjusting grinding wheel.

According to the first embodiment, the grinding wheel core 11 is explained to be formed by WA grinding wheel which is formed by sintering powder of alumina ($Al_2O_3$) or the GC grinding wheel which is formed by sintering powder of silicon carbide (SiC) to achieve a weight reduction. It is noted however, the material for forming the grinding wheel core 11 is not limited thereto.

According to the second embodiment, the resin made guides 21 and 22 are attached to both sides of the abrasive grain layer 15. However, the resin made guide may be attached to one of the both sides of the abrasive grain layer 15 to achieve the effect of the invention.

Obviously, numerous modifications and variations of the present invention are possible in light of the above teachings. It is therefore to be understood that within the scope of the appended claims, the present invention may be practiced otherwise than as specifically described herein.

REFERENCE SIGNS LIST

10, 100; abrasive grinding wheel, 11, 111; grinding wheel core, 11*a*, 111*a*; outer peripheral surface, 11*b*, 11*c*, 111*b*, 111*c*; both side surfaces, 11*d*, 111*d*; inner peripheral surface, 14, 14*a*, 14*b*, 14*c*; adhesive agent, 15; abrasive grain layer, 17; water proof agent, 21, 22; resin made guide.

The invention claimed is:

1. An abrasive grinding wheel, comprising:

an annular abrasive grain layer bound with a diamond abrasive grain or a cubic boron nitride (CBN) abrasive grain by a binder agent and fixed to an outer peripheral surface of a cylindrical grinding wheel core, which is formed by white alundum (WA) or a green carbon (GC) material, by waterproofing adhesive agent, wherein the waterproofing adhesive agent is disposed on the outer peripheral surface of the cylindrical grinding wheel core; and a waterproof agent is disposed on both side surfaces and an inner peripheral surface of the cylindrical grinding wheel core, and wherein the waterproof agent is also disposed on said both side surfaces to a position where said waterproof agent overlaps with said waterproofing adhesive agent.

2. The abrasive grinding wheel according to claim 1, wherein a resin-made guide member is fixed by the waterproofing adhesive agent to at least one end of the annular abrasive grain layer in an axial line direction of the cylindrical grinding wheel core.

3. The abrasive grinding wheel according to claim 1, wherein the annular abrasive grain layer has a same length in an axial line direction as a length of the cylindrical grinding wheel core in the axial line direction.

4. The abrasive grinding wheel according to claim 1, wherein a side surface of the annular abrasive grain layer and said both side surfaces of the cylindrical grinding wheel core are coplanar.

5. The abrasive grinding wheel according to claim 1, wherein the waterproofing adhesive agent is an epoxy resin.

6. The abrasive grinding wheel according to claim 2, wherein a length of the annular abrasive grain layer in an axial line direction is larger than a length of the cylindrical grinding wheel core in the axial line direction.

7. The abrasive grinding wheel according to claim 1, wherein resin-made guide members are fixed by the waterproofing adhesive agent to both ends of the annular abrasive grain layer in an axial line direction of the cylindrical grinding wheel core.

8. The abrasive grinding wheel according to claim 1, wherein the waterproofing adhesive agent and the waterproof agent cover an entire outer surface area of the cylindrical grinding wheel core.

9. The abrasive grinding wheel according to claim 1, wherein the white alundum (WA) comprises a sintered powder of alumina.

10. The abrasive grinding wheel according to claim 1, wherein the green carbon (GC) material comprises a sintered powder of silicon carbide.

* * * * *